US007299918B1

(12) United States Patent
Patrick

(10) Patent No.: US 7,299,918 B1
(45) Date of Patent: Nov. 27, 2007

(54) COIN STORAGE AND DISPLAY ASSEMBLY

(76) Inventor: Ronald R. Patrick, 404 Robinson Dr., Tustin, CA (US) 92782

( * ) Notice: Subject to any disclaimer, the term of this patent is extended or adjusted under 35 U.S.C. 154(b) by 529 days.

(21) Appl. No.: 11/049,505

(22) Filed: Feb. 3, 2005

(51) Int. Cl.
*A45C 1/00* (2006.01)

(52) U.S. Cl. ..... 206/0.81; 206/0.83; 206/0.84

(58) Field of Classification Search ..... 206/0.8, 206/0.81, 0.83, 0.84, 457, 459.5; D99/34, D99/37

See application file for complete search history.

(56) References Cited

U.S. PATENT DOCUMENTS 4,043,477 A * 8/1977 Deese ..... 220/23.4
5,191,972 A * 3/1993 Helzer et al. ..... 206/0.84
5,988,366 A 11/1999 Krull et al.
D428,680 S 7/2000 Hildebrand et al.
D441,397 S 5/2001 Flax
D450,908 S 11/2001 Brown
D454,244 S 3/2002 Scheff
D472,692 S 4/2003 Reidenbach
6,604,627 B1 8/2003 Kennedy
6,679,372 B1 * 1/2004 Shaffer ..... 206/0.84

* cited by examiner

*Primary Examiner*—David T. Fidei

(57) ABSTRACT

A coin storage and display assembly includes a panel that has a front side and a back side. The panel has a generally rectangular shape. United States flag indicia are positioned on the front side and consist of a canton and thirteen stripes. The canton has fifty star shaped depressions therein. Each of a plurality of inserts has a size and shape adapted for being removably positioned in and frictionally coupled to one of the depressions. Each of the inserts has a first side and a second side. Each of the first sides has a circular shaped indentation therein. The indentations each have a diameter equal to a coin, such as a quarter. Each of a plurality of quarters may be removably positioned in one of the indentations and each of the inserts may be removably positioned in one of the depressions.

9 Claims, 2 Drawing Sheets

COIN STORAGE AND DISPLAY ASSEMBLY

BACKGROUND OF THE INVENTION

1. Field of the Invention

The present invention relates to coin holding devices and more particularly pertains to a new coin holding device for holding and displaying United Stated quarters.

2. Description of the Prior Art

The use of coin holding devices is known in the prior art. U.S. Pat. No. 5,988,366 describes a map of the United States having openings positioned in each of the states for holding a coin which is presumably a United States quarter. Another type of coin holding device is U.S. Pat. No. 6,604,627 again showing a map of the United States having positions therein for holding quarters. U.S. Design Pat. No. 450,908 shows a United States flag having a plurality of flaps or pockets positioned on the stars for holding and displaying quarters. U.S. Design Pat. No. 441,397 shows an album adapted for holding commemorative quarters.

While these devices fulfill their respective, particular objectives and requirements, the need remains for a device which is readily adapted for holding quarters in an attractive format. The device should be adapted for allowing easy filling or removal of the quarters when desired, but should also ensure that the quarters are secure enough in their saddles that the device may be mounted without fear of losing quarters.

SUMMARY OF THE INVENTION

The present invention meets the needs presented above by comprising a panel that has a front side and a back side. The panel has a generally rectangular shape. United States flag indicia are positioned on the front side and consist of a canton and thirteen stripes. The canton has fifty star shaped depressions therein. Each of a plurality of inserts has a size and shape adapted for being removably positioned in and frictionally coupled to one of the depressions. Each of the inserts has a first side and a second side. Each of the first sides has a circular shaped indentation therein. The indentations each have a diameter equal to a coin, such as a quarter. Each of a plurality of quarters may be removably positioned in one of the indentations and each of the inserts may be removably positioned in one of the depressions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
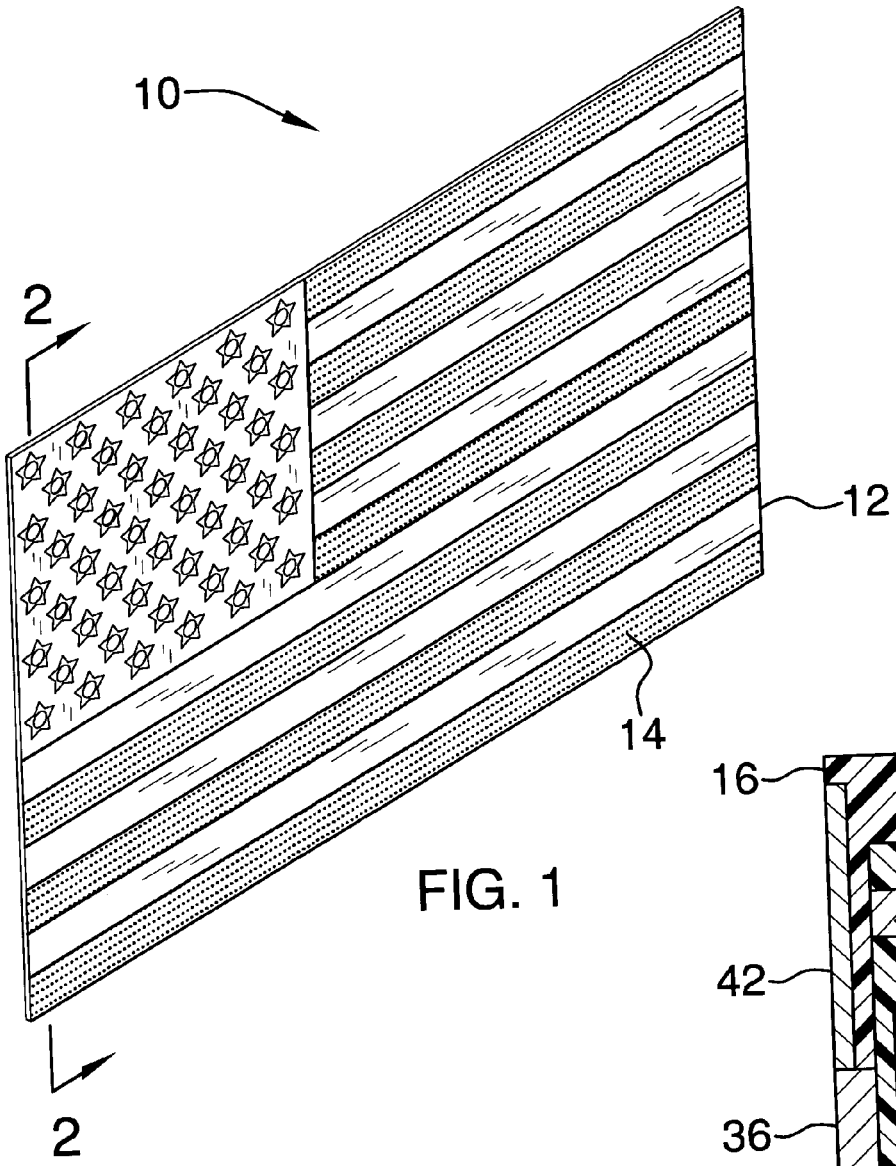
FIG. 1 is a perspective view of a coin storage and display assembly according to the present invention.
Figure 2:
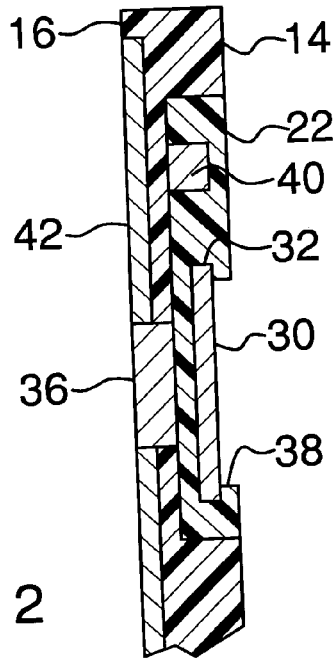
FIG. 2 is a cross-sectional view taken along line 2-2 of FIG. 1 of the present invention.
Figure 3:
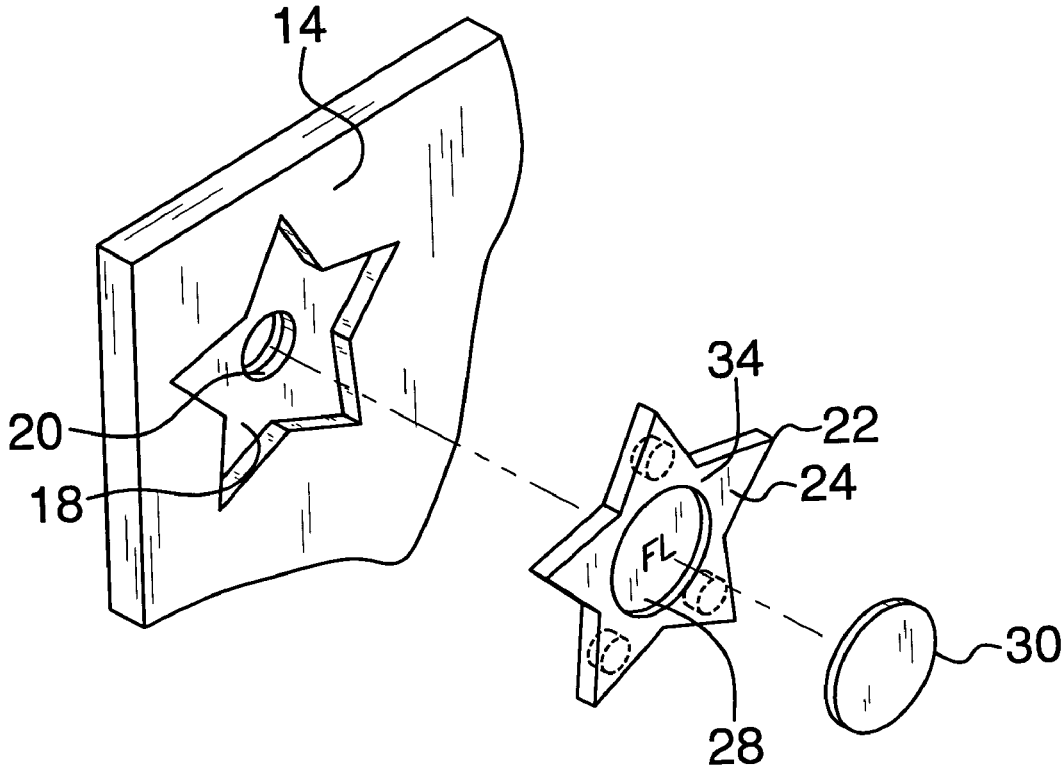
FIG. 3 is an expanded, front perspective view of the present invention.
Figure 4:
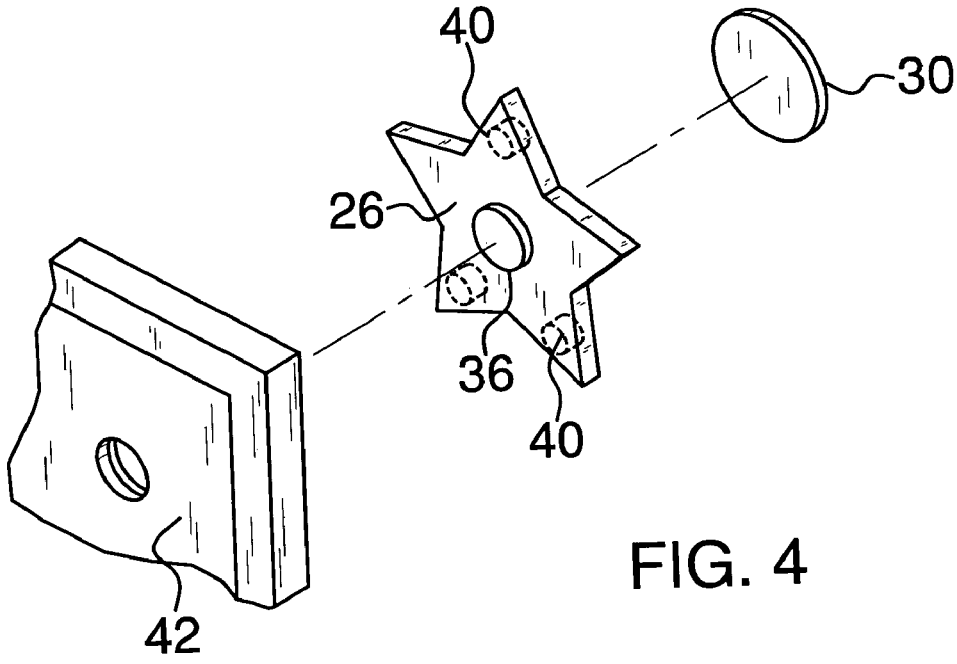
FIG. 4 is an expanded, rear perspective view of the present invention.

With reference now to the drawings, and in particular to FIGS. 1 through 4 thereof, a new coin holding device embodying the principles and concepts of the present invention and generally designated by the reference numeral 10 will be described.

As best illustrated in FIGS. 1 through 4, the coin storage and display assembly 10 generally comprises a panel 12 that has a front side 14 and a back side 16, the panel 12 has a generally rectangular shape. United States flag indicia is positioned on the front side and consists of a canton and thirteen stripes. The canton has fifty star shaped depressions 18 therein positioned as would be found on a traditional United States flag. The panel 12 has fifty apertures 20 extending therethrough. Each of the depressions 18 has one of the apertures 20 therein. The panel 12 is preferably comprised of a plastic material.

A plurality of inserts 22 is provided. Each of the inserts 22 has a size and shape adapted for being removably positioned in and frictionally coupled to one of the depressions 18. Each of the inserts 22 has a first side 24 and a second side 26. The first sides 24 each have a circular shaped indentation 28 therein. The indentations 28 each have a diameter equal to a coin, and ideally the coin size to be used is that of a standard quarter 30. Each of the indentations 28 has a perimeter edge 32. The inserts 22 are each comprised of a resiliently flexible material such as a plastic or elastomer. Indicia 34 representing the names of the states may be positioned in each of the indentations 28.

A plurality of nubs 36 is provided and each is attached to one of the second sides 26 of the inserts 22. Each of the nubs 36 is positioned for being removably extended into one of the apertures 20 when the inserts 22 are positioned in the depressions 18. The nubs 36 preferably have a size and shape for frictionally engaging an edge of a respective one of the apertures 20 to aid in retaining the inserts 22 in the depressions 18.

A plurality of perimeter lips 38 is provided. Each of the perimeter lips 38 is integrally attached to and extends along a perimeter edge 32 of each of the indentations 18. Each of the perimeter lips 38 is positioned adjacent to the first sides 24 of each of the inserts 22.

Each of a plurality of magnets 40 is positioned within one of the inserts 22 so that each of the inserts 22 has at least one magnet 40 positioned therein. It is preferred that each of the inserts 22 has at least two magnets 40 positioned therein, and more preferably three magnets 40 positioned therein. A metallic plate 42 is attached to the back side of the panel. The plate 42 is substantially a same size as the canton and is aligned with the canton. Each of the apertures 20 in the panel 12 extends through the plate 42. The plate 42 is magnetically attracted to the magnets 40 to further aid in retaining the inserts 22 in the depressions 18.

In use, wherein each of a plurality of quarters 30 may be removably positioned in one of the indentations 28 and each of the inserts 22 may be removably positioned in one of the depressions 18. The perimeter edges 32 of the indentations 28 hold the quarters 30 in place, though the perimeter lips 38 also aid in holding the quarters 30 in the indentations 28. Once the inserts 22 are in the depressions 18, they may be easily removed from the panel 12 by pressing them out of the depressions 18 via the apertures 20. The inserts 22, by being flexible, allows a person to bend the inserts 22 to remove the quarters 30.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An assembly adapted for removably receiving and storing a plurality of coins, said assembly comprising:

a panel having a front side and a back side, said panel having a generally rectangular shape, United States flag indicia being positioned on said front side and consisting of a canton and thirteen stripes, said canton having fifty star shaped depressions therein; and a plurality of inserts, each of said inserts having a size and shape adapted for being removably positioned in and frictionally coupled to one of said depressions, each of said inserts having a first side and a second side, each of said first sides having a circular shaped indentation therein, each of said indentations having a diameter equal to a coin, said coin being a quarter; and wherein each of a plurality of quarters may be removably positioned in one of said indentations and each of said inserts may be removably positioned in one of said depressions.

2. The assembly according to claim 1, wherein said panel has fifty apertures extending therethrough, each of said depressions having one of said apertures therein.

3. The assembly according to claim 1, wherein each of said indentations having a perimeter edge, a plurality of perimeter lips, each of said perimeter lips being integrally attached to and extending along a perimeter edge of each of said indentations, each of said perimeter lips being positioned adjacent to said first sides of each of said inserts.

4. The assembly according to claim 3, wherein each of said inserts is comprised of a resiliently flexible material.

5. The assembly according to claim 1, further including:

a plurality of magnets, each of said magnets being positioned within one of said inserts such that each of said inserts has at least one magnet positioned therein; and a metallic plate being attached to said back side of said panel.

6. The assembly according to claim 5, wherein said plate is substantially a same size as said canton and is aligned with said canton.

7. The assembly according to claim 2, further including:

a plurality of magnets, each of said magnets being positioned within one of said inserts such that each of said inserts has at least two magnets positioned therein; and a metallic plate being attached to said back side of said panel, each of said apertures in said panel extends through said plate.

8. The assembly according to claim 7, wherein said plate is substantially a same size as said canton and is aligned with said canton.

9. An assembly adapted for removably receiving and storing a plurality of coins, said assembly comprising:

a panel having a front side and a back side, said panel having a generally rectangular shape, United States flag indicia being positioned on said front side and consisting of a canton and thirteen stripes, said canton having fifty star shaped depressions therein, said panel having fifty apertures extending therethrough, each of said depressions having one of said apertures therein, said panel being comprised of a plastic material;

a plurality of inserts, each of said inserts having a size and shape adapted for being removably positioned in and frictionally coupled to one of said depressions, each of said inserts having a first side and a second side, each of said first sides having a circular shaped indentation therein, each of said indentations having a diameter equal to a coin, said coin being a quarter, each of said indentations having a perimeter edge, each of said inserts being comprised of a resiliently flexible material;

a plurality of nubs, each of said nubs being attached to one said second sides of said inserts such that each of said inserts has one nub attached thereto, each of said nubs being positioned for being removably extended into one of said apertures when said inserts are positioned in said depressions, said nubs having a size and shape for frictionally engaging an edge of a respective one of said apertures;

a plurality of perimeter lips, each of said perimeter lips being integrally attached to and extending along a perimeter edge of each of said indentations, each of said perimeter lips being positioned adjacent to said first sides of each of said inserts;

a plurality of magnets, each of said magnets being positioned within one of said inserts such that each of said inserts has at least two magnets positioned therein;

a metallic plate being attached to said back side of said panel, said plate being substantially a same size as said canton and being aligned with said canton, each of said apertures in said panel extending through said plate; and wherein each of a plurality of quarters may be removably positioned in one of said indentations and each of said inserts may be removably positioned in one of said depressions.

* * * * *